US007118466B2

(12) United States Patent
Laney

(10) Patent No.: US 7,118,466 B2
(45) Date of Patent: Oct. 10, 2006

(54) SCISSOR SHARPENING MACHINE

(76) Inventor: W. L. Laney, 2879 Breezy La., Castle Rock, CO (US) 80109

( * ) Notice: Subject to any disclaimer, the term of this patent is extended or adjusted under 35 U.S.C. 154(b) by 0 days.

(21) Appl. No.: 11/285,081

(22) Filed: Nov. 23, 2005

(65) Prior Publication Data

US 2006/0111027 A1 May 25, 2006

Related U.S. Application Data

(63) Continuation-in-part of application No. 11/159,069, filed on Nov. 22, 2004.

(51) Int. Cl.
*B24B 3/52* (2006.01)

(52) U.S. Cl. ..... 451/293; 451/276; 451/349

(58) Field of Classification Search ..... 451/272, 451/276, 282, 293, 45, 349, 549, 226, 229, 451/193; 76/82.2
See application file for complete search history.

(56) References Cited

U.S. PATENT DOCUMENTS

| | | | | |
|---|---|---|---|---|
| 551,717 A | | 12/1895 | Buchop et al. | |
| 1,381,416 A | * | 6/1921 | Heindl | 451/224 |
| 2,753,666 A | * | 7/1956 | Sasse | 451/224 |
| 2,769,281 A | | 11/1956 | Jones | |
| 3,733,751 A | | 5/1973 | Williams | |
| 3,879,899 A | | 4/1975 | Ribar | |
| 3,885,352 A | | 5/1975 | Juranitch | |
| 3,910,159 A | | 10/1975 | Gladwin | |
| 4,528,778 A | * | 7/1985 | Wolff | 451/224 |
| 4,961,288 A | | 10/1990 | Ketteringham | |
| 5,157,870 A | | 10/1992 | Pike | |
| 5,218,787 A | | 6/1993 | Rice | |
| 5,311,703 A | | 5/1994 | Ketteringham | |
| 5,938,511 A | | 8/1999 | Patterson | |
| 5,941,763 A | | 8/1999 | Kaye | |
| D505,683 S | | 5/2005 | Pfaff | |
| 2003/0186637 A1 | | 10/2003 | Kaye | |

FOREIGN PATENT DOCUMENTS

| | | | |
|---|---|---|---|
| DE | 144728 | * 11/1980 | 451/276 |
| EP | 0249588 | 12/1987 | |
| JP | 59-115151 | 7/1984 | |
| JP | 02-036057 | 2/1990 | |

OTHER PUBLICATIONS

"HTTP://WWW.BONIKA.COM/SCSCSHFL.HTML," Scimech Scissors Sharpening Equipment, Printed From Website Aug. 9, 2005, Three Pages.

(Continued)

*Primary Examiner*—Robert A. Rose
(74) *Attorney, Agent, or Firm*—Richard C. Litman

(57) ABSTRACT

The scissor sharpening machine includes a honing disc with a curved blade guide and a blade clamp assembly which slides axially along the blade guide. The curvature of the blade guide corresponds to the conventional curvature along the lengths of the blades of a pair of high quality scissors or shears, and assures that they are sharpened properly. The blade clamp assembly includes a series of predetermined stops to set the proper bevel angle during the sharpening process. However, the blade may be rocked about its longitudinal axis to the limit set by the stop, in order to provide a convex curvature to the blade edge if so required. The apparatus may include a cabinet with motor controls and other components, and the blade guide and blade clamp assemblies may be adjusted and repositioned to allow sharpening of either left hand or right hand scissors and shears.

20 Claims, 6 Drawing Sheets

OTHER PUBLICATIONS

"HTTP://WWW.DIAMONDROSESHEARS.COM/ABOUT-US.HMTL," Background From Applicant's Website, Printed Aug. 9, 2005, Two Pages.

"HTTP://WWW.RAPIDEDGE.COM/HTML/MACHINE.HTM," Multiple Disc Sharpening Machine, Printed From Website Aug. 9, 2005, Four Pages.

"HTTP://WWW.SAW-TOOLSHARPENING.COM/SCIS-SORSHARPENING01.HTML," Foley-Belsaw Sharpening Machines, Printed From Website Jun. 24, 2005, Six Pages.

"HTTP://WWW.SCISSORWORLD.BIZ/BO_BMACHINE.HTM," Sharpline Whiz Sharpening Machine, Printed From Website Aug. 9, 2005, Three Pages.

* cited by examiner

SCISSOR SHARPENING MACHINE

REFERENCE TO RELATED PATENT APPLICATION

This application is a continuation in part of U.S. patent application Ser. No. 11/159,069, filed on Nov. 22, 2004.

BACKGROUND OF THE INVENTION

1. Field of the Invention

The present invention relates generally to sharpening tools and equipment. More specifically, the present invention comprises a scissor sharpening machine which retains the conventional curvature along the length of the scissor blade, while simultaneously providing the proper bevel angle or convex edge across the edge of the blade during the sharpening process.

2. Description of the Related Art

High quality scissors and shears are conventionally constructed with the cutting edges of the blades having a large radius curvature along their lengths, in order to provide a more constant included angle between the two blades as they close upon one another during the cutting operation. The radius of curvature used is nearly universally 800 millimeters, or about 31.5 inches. This is particularly true of scissors and shears used in the hair cutting and beauty salon fields, where the scissors used are nearly always quite costly to purchase and of very high quality.

Some of these scissors may cost as much as a few hundred dollars to purchase. Naturally, the owners of such costly scissors are concerned that when they are periodically sharpened, that the sharpening operation be conducted properly. This is not always the case with many conventional sharpening machines and operations. Many of the existing scissor sharpening machines available do not follow the true curvature along the length of the scissor blade, but rather form a series of straight edges with slight angles therebetween. Other sharpening machines have been constructed to follow the 800 mm curvature along the length of the blade, but cannot provide an accurate bevel angle along the blade edge, or form the required convex curvature of the blade edge where such curvature is required.

The present inventor is aware of various scissor sharpening machines and tools which have been developed in the past. One such device is described in Japanese Patent Publication No. 59-115,151 published on Jul. 3, 1984, comprising a manually powered device having a guide roller for the honing stone with the guide roller having a convex curvature along its length in order to follow the curvature of the blade along the length of its cutting edge. While the angle of the scissor blade may be set to form a specific bevel along the blade edge, there is no means to provide a convex edge, as is required for some scissor blades.

Japanese Patent Publication No. 2-036,057 published on Feb. 6, 1990 describes (according to the drawings and English abstract) two sets of rotary grindstones having a variably adjustable angle between the axes of the two sets. This allows the angle of the cutting edge to be adjusted according to that originally manufactured for the blade. However, this device cannot follow the 800 mm (or other) curvature along the length of a scissor blade, nor can it allow the blade to be rotated about its elongate axis during the sharpening operation in order to form a convex curvature along the cutting edge of the blade.

None of the above inventions and patents, taken either singly or in combination, is seen to describe the instant invention as claimed. Thus, a scissor sharpening machine solving the aforementioned problems is desired.

SUMMARY OF THE INVENTION

The scissor sharpening machine includes an interchangeable circular honing disc, a blade guide assembly, and a blade clamp assembly which moves along the blade guide assembly during the sharpening operation. The blade guide assembly includes a guide bar having an 800 mm radius curvature (or other curvature, depending upon the requirements of the blade to be sharpened), with the blade clamp assembly being slidably secured along the guide bar. Precision bearings are used between the blade clamp assembly and the guide bar, in order to, preclude any movement of the clamp assembly relative to the guide bar other than axially along the length of the guide bar and circumferentially about the guide bar. The blade clamp assembly includes a stop pin and a series of stop holes or passages for setting the blade edge bevel angle relative to the honing disc as required, depending upon the originally manufactured blade edge bevel angle.

The device is used by clamping a scissor blade within the clamp assembly, adjusting its angle relative to the honing disc, and setting the blade clamp stop to correspond with the bevel angle of the blade edge. Power is then applied to rotate the circular honing disc, and the scissor blade is drawn back and forth from its tip to its root along the edge of the honing disc to sharpen the blade. The bevel angle of the blade is determined according to the predetermined stop set in the clamp assembly, which limits the angle of the blade relative to the honing disc. However, the blade may be rotated about its longitudinal axis to the limit set by the stop, in order to form a convex curvature along the blade edge if such is required. The 800 mm curvature along the length of the blade is assured according to the correspondingly curved guide bar, along which the blade clamp assembly travels during the sharpening operation.

The above described sharpening machine may further include a cabinet for housing the drive motor for the honing disc, as well as speed and directional controls for the motor. The cabinet preferably includes means for repositioning the guide bar assembly and other components in order to allow the apparatus to be reversed for sharpening both left hand and right hand scissors, as desired.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention comprises a scissor sharpening machine capable of maintaining the proper curvature along the length of a scissor blade, as well as maintaining the proper bevel angle or convex curvature (depending upon the specific scissor blade configuration) across the blade edge. The present machine proper includes a curved blade guide bar with a blade clamp assembly slidably disposed therealong, to accommodate the curvatures and angles required in sharpening a high quality pair of scissors or shears. However, the present invention may include a base cabinet with its motorized flat plate honing disc and other features and/or accessories, as well.

Figure 1:
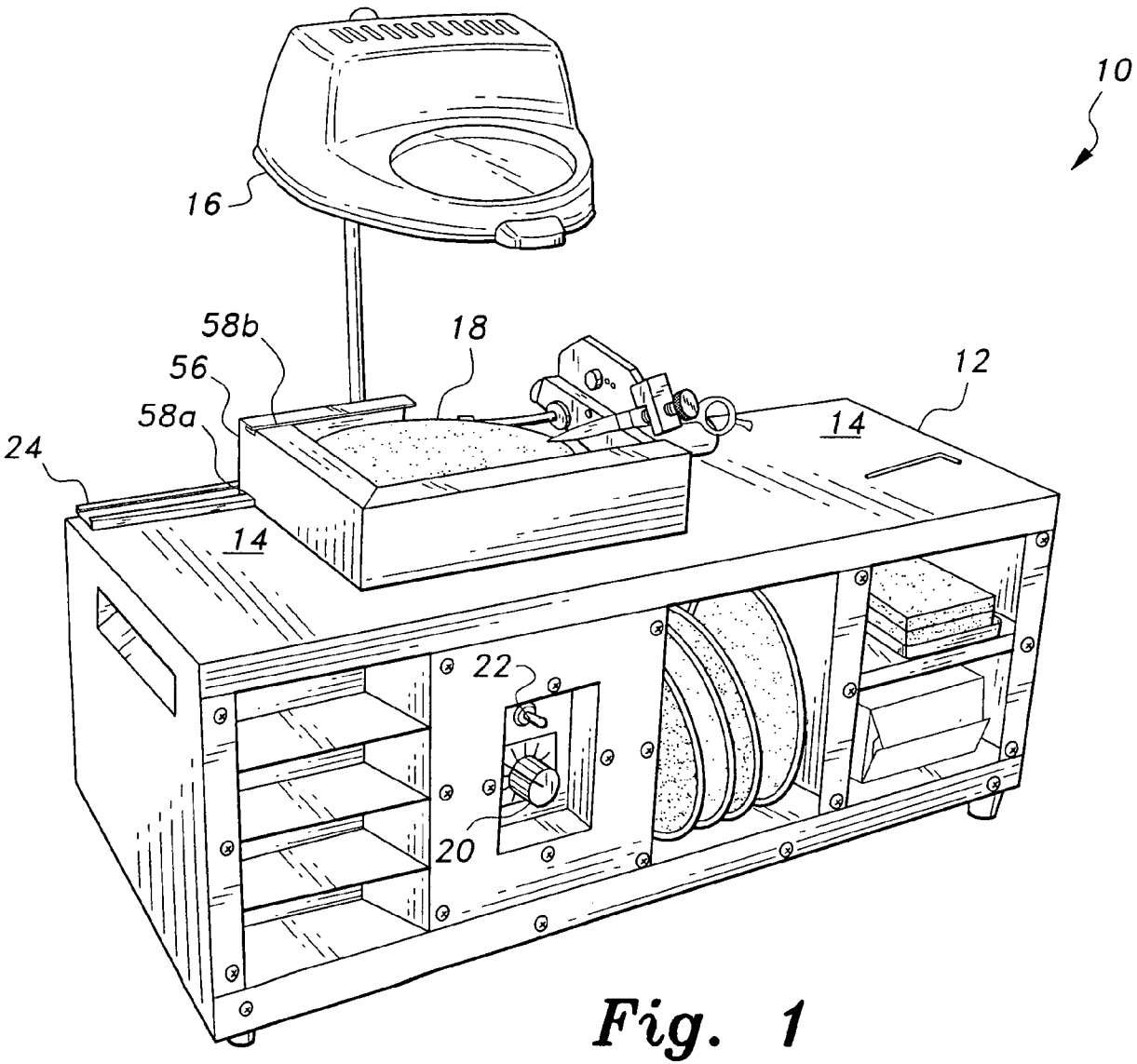
FIG. 1 is an environmental, perspective view of a scissor sharpening machine according to the present invention, including the cabinet and other components, in readiness for operation.
Figure 2:
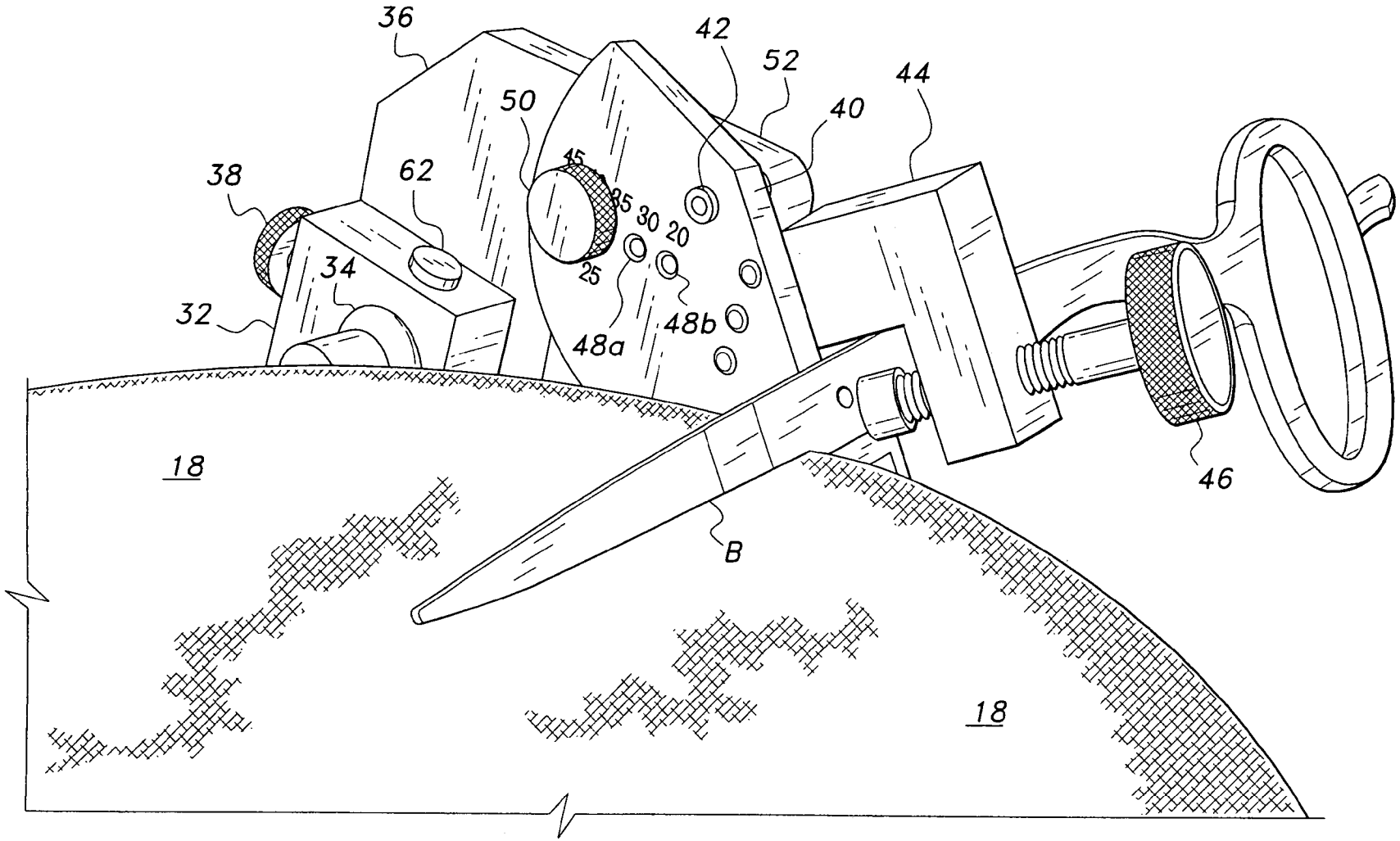
FIG. 2 is a detailed perspective view of a portion of the honing disc with a scissor blade secured thereover by the blade clamp mechanism, and showing details of the blade angle stop mechanism.

FIG. 1 provides a perspective view of the present scissor sharpening machine and cabinet in combination therewith, collectively identified by the reference numeral 10. The cabinet 12 provides a flat mounting base 14 thereatop for the installation of the sharpening machine apparatus thereon, and may include additional storage areas for different honing and polishing discs and other articles as desired. A light and magnification lens 16 is installed conventionally above the mounting base surface 14, to facilitate the precision work required when sharpening a high quality pair of scissors or shears. The cabinet 12 is relatively small and lightweight, and may be placed upon a cart or carried by hand for portability. The cabinet 12 includes a conventional electric motor (not shown) which drives a flat blade sharpening or honing disc 18, with the disc 18 extending above the machine mounting base 14 at the top of the cabinet 12 and rotating in a plane parallel to the plane of the mounting base surface 14. Appropriate motor controls, e.g. a speed rheostat or control 20 and rotational direction switch 22, are provided at some convenient location on the cabinet 12.

Figure 3:
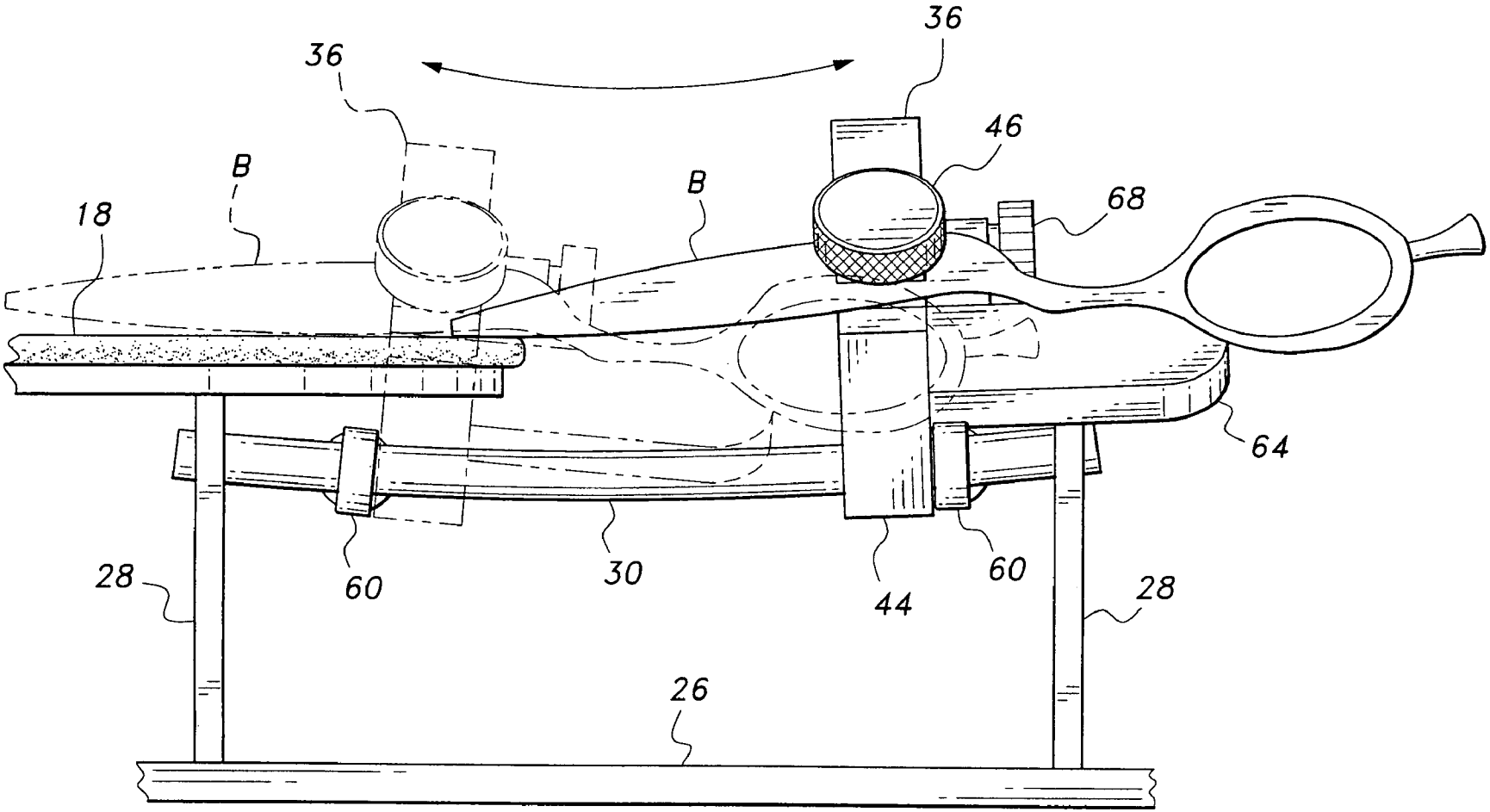
FIG. 3 is a front elevation view of the curved blade guide assembly and honing disc, showing the arcuate movement of the blade clamp assembly and blade during the sharpening operation to follow the curvature of the blade along its length.
Figure 4:
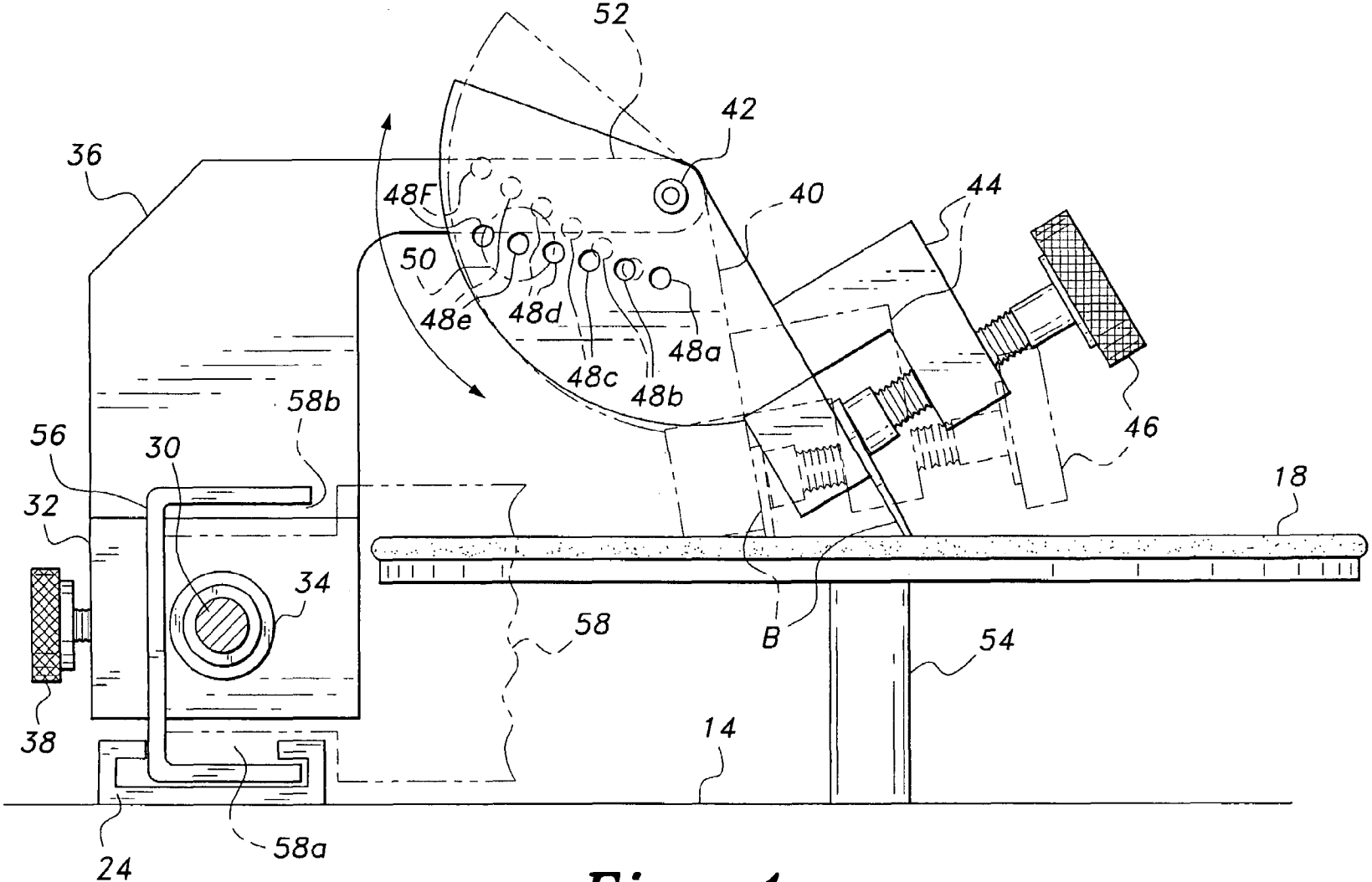
FIG. 4 is an end elevation view of the blade guide assembly and blade clamp assembly thereon, showing further details of the blade angle stop mechanism.
Figure 5:
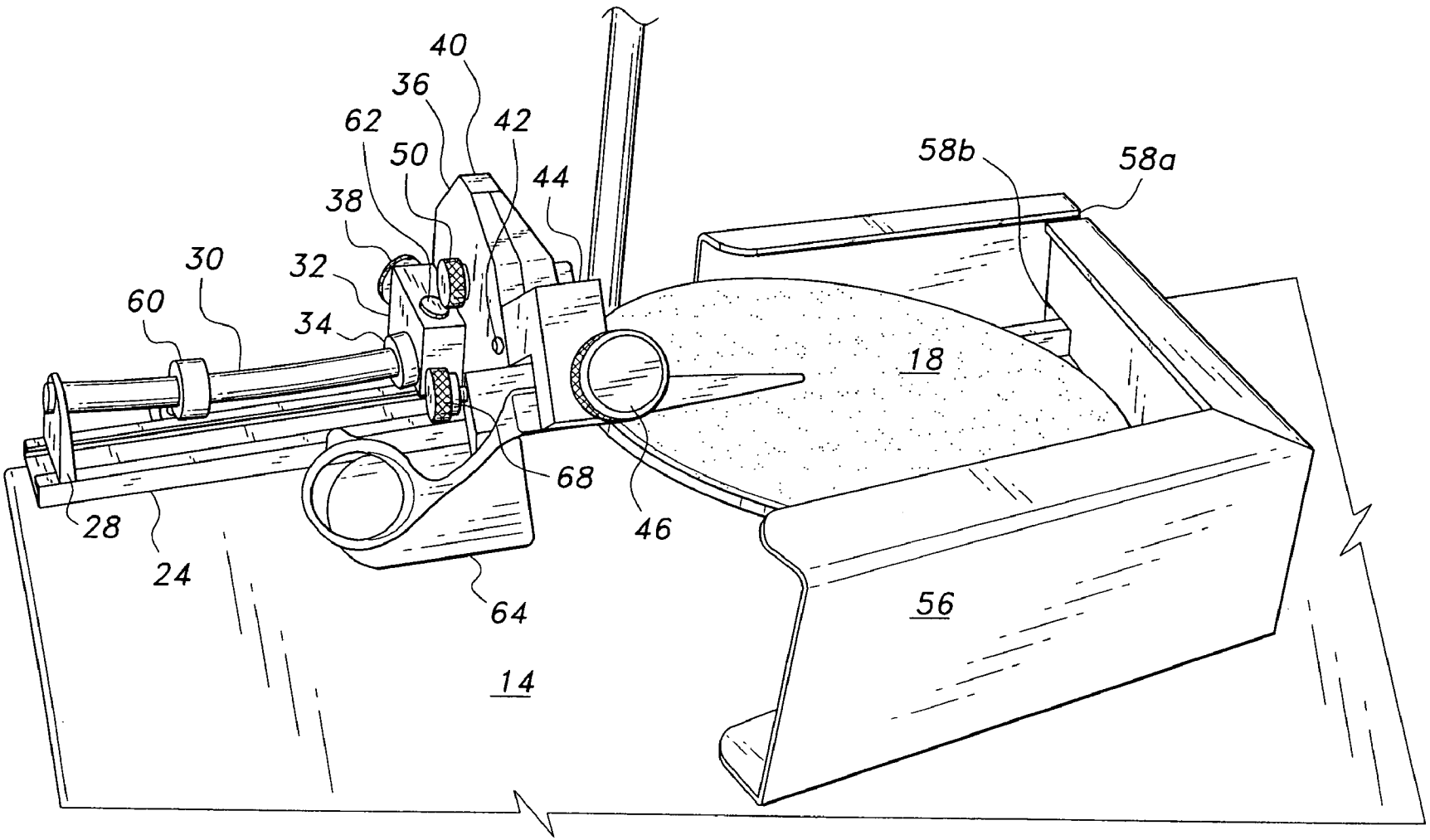
FIG. 5 is a detailed perspective view of the present scissor sharpening machine set up for sharpening the blade of a left hand pair of scissors.

FIGS. 3 through 5 illustrate details of the guide bar track assembly which serves to attach the present sharpening apparatus to the cabinet 12. A guide bar track 24 (shown in FIGS. 1, 4 and 5) is permanently and immovably affixed atop the mounting base surface 14 adjacent to the honing disc 18, with the track 24 providing for the removable and adjustable attachment to the cabinet of the various components comprising the present sharpening machine as well as positioning those components adjacent to the honing disc 18. The track 24 may comprise a flattened "U" channel cross section with inwardly turned retaining flanges, as shown, or a "T" cross section or other suitable shape or configuration as desired.

A guide bar support plate 26 is secured within the guide bar track 24, e.g. with allen screws or other suitable locking means. The guide bar plate 26, and all structure attached thereto, may be adjusted and secured linearly along the track 24 as required, depending upon the sharpening operation being performed. The guide bar plate 26 includes two mutually opposed bar supports 28, with a curved guide bar 30 extending therebetween. The guide bar 30 is curved toward the guide bar support plate 26 between the ends of the bar 30, preferably having a radius of 800 millimeters or about 31.5 inches. This corresponds to the 800 mm curve along the lengths of the blades of most high quality scissors and shears, and enables the present machine to hone and sharpen such curved blade edges accurately while maintaining the desired curvature. However, it will be understood that the guide bar plate 26 and its guide bar 30 may be exchanged for other plate and bar assemblies having guide bars of other radii corresponding to other blade curvatures, if so desired. The process by which a scissor blade B is sharpened along the length of its curved edge is explained in detail further below, following a detailed description of the structure of the present blade sharpening device.

FIGS. 2 and 4 through 6 provide illustrations of the blade clamp assembly which extends from the curved guide bar 30. A blade clamp assembly is slidably secured to and extends generally radially from the curved guide bar 30. The blade clamp assembly includes a blade clamp base 32 which is secured to the guide bar 30 by a linear bearing 34. The bearing 34 allows the clamp arm base 32 to slide linearly along the guide bar 30 and to rotate around the guide bar. However, the linear bearing 34 precludes any angular shifting or play of the clamp arm base 32 relative to the guide bar 30, i.e. the bearing axis of the clamp arm base 32 remains in angular alignment with the longitudinal axis of the guide bar 30. (However, the clamp arm 36 and clamp which extend from the clamp arm base 32 are angularly adjustable relative to the base 32, as illustrated particularly in FIGS. 2, 4, and 6 and explained further below.)

A blade clamp arm 36 is secured to the blade clamp arm base 32, and may be articulated through a limited angular range relative to the curved guide bar 30. The clamp arm 36 is positionally locked to the clamp arm base 32 by a position lock screw 38. When this locking screw 38 is loosened, the blade clamp arm 36 may be swiveled slightly to the left or to the right (when viewed from above) to position the blade clamp assembly for sharpening left or right hand scissor blades, as appropriate. This procedure is explained in detail further below.

A scissor blade clamp 40 is pivotally secured to the blade clamp arm 36 at pivot 42. This arrangement allows the jaws of the blade clamp 40, and accordingly a scissor blade B clamped therein, to be set at a limit relative to the honing or sharpening disc 18 corresponding to the edge angle of the blade. FIG. 4 of the drawings provides a clear illustration of this principle. The blade clamp 40 includes a jaw 44 having a clamping screw 46 therein, which secures the scissor blade B between the clamping screw and the base of the clamp assembly. The clamp 40 also includes a series of holes or passages **48*a* through 48*f* therethrough, and parallel to the axis of the pivot 42. A limit pin 50 (shown in broken lines in FIG. 4, for clarity in the drawing Fig.) is selectively installed within one of these blade angle limiting passages 48*a* through 48*f*, to limit the angular travel of the blade clamp 40 relative to the blade clamp arm 36. The limit or stop pin 50 contacts the underside (shown in FIG. 4) of the extension 52 of the blade clamp arm 36 to limit the angular motion of the blade clamp 40 relative to the clamp arm 36**.

The series of holes or passages **48*a* through 48*f* correspond to the various blade edge angles conventionally provided by scissor manufacturers, and allow the user of the present device to set the blade angle precisely relative to the honing or sharpening disc 18 when the blade clamp arm 36 is lowered to place the blade edge against the honing disc 18. The holes 48*a* through 48*f* are preferably formed to provide a series of incremental jaw angle stops separated by five degrees from one another and beginning at twenty degrees, i.e. 20, 25, 30, 35, 40, and 45 degrees. These angles correspond to the blade edge bevel angles found in virtually all commercially manufactured scissors. However, it will be seen that other blade angle stops or limits may be provided in the present tool or machine, merely by forming the stop or limit holes in different locations along the arm 40 as desired. In the example shown in FIG. 4, the upper edge of the stop pin hole 48***e* is precisely aligned with the lower surface of the clamp arm extension 52, as would be the case if the stop pin 50 were installed through the hole 48*e* and the jaw 44 lowered to its maximum extent. This corresponds to a blade bevel angle of 40 degrees, as commonly found in many commercially manufactured scissors and shears.

FIGS. 1 through 4 illustrate the operation and use of the present scissor sharpening machine with a blade B from a right hand pair of scissors. The machine is used by first installing the desired honing or polishing disc 18 on the motor spindle or shaft 54 (shown in FIG. 4), and confirming that the rotational direction switch 22 (FIG. 1) is set for the desired direction of rotation for the disc 18. The disc speed control 20 may also be set as desired at this time, if a separate on/off switch is provided for the disc drive motor. The blade clamp assembly, comprising the blade clamp arm 36 and blade clamp 40, is oriented relative to the blade clamp base 32 for right hand sharpening operations (as shown in solid lines in FIG. 6), and the left/right arm position lock screw 38 is secured. Also, a splash guard 56 is installed on the track 24 to preclude lateral splash or spatter from water used on the disc during the sharpening process. The guard 56 includes two opposed slots 58*a* and 58*b* along one side thereof, allowing that side to be slid into place along the track 24. The guard 56 is shown installed to the left side of the disc 18 in FIG. 1 for right hand blade sharpening operations, with the slot 58*a* engaging the track 24.

The right hand scissor blade B may then be positioned and clamped within the blade clamp jaw 44. The blade configuration has been determined by this point, i.e. the bevel angle or convex curvature across the blade edge, and the blade jaw angle limit pin 50 is installed in the appropriate hole or passage 48*a* through 48*f* in the blade clamp 40. In the example illustrated in FIGS. 2 and 4, the pin 50 has been installed in the forty degree bevel angle hole or passage 48*e*.

At this point the blade clamp assembly is positioned generally medially along the length of the curved guide bar 30, and the blade B is adjustably positioned in the jaw 44 to allow both the base end and the tip of blade B to reach the edge of the disc 18 as the blade clamp assembly slides back and forth along the curved guide bar 30. Stops 60 (FIGS. 3, 5, and 6) are secured in place at the desired travel limits of the blade clamp assembly along the guide bar 30, and corresponding travel of the blade B back and forth across the edge of the disc 18. Minor fine adjustment may be accomplished as needed at this point, to assure that the cutting edge of the blade B remains in constant contact with the honing or polishing disc 18 as the blade B is moved back and forth as the blade clamp assembly traverses the curved guide bar 30.

Once the above adjustments have been completed, the actual sharpening operation may be carried out. The blade clamp arm assembly, comprising the blade clamp base 32, blade clamp arm 36, blade clamp 40, and blade clamp jaw 44 with the right hand scissor blade B secured therein, is rotated about the guide bar 30 for clearance, and power is applied to the honing disc 18, either by turning on and setting the speed control 20 as desired, or by means of a separate on/off switch. The honing disc 18 is moistened as desired or required; water is generally applied to the disc to keep the blade edge cool during honing operations. The blade clamp arm assembly is then rotated about the guide arm 30 to lower the cutting edge of the blade B into contact with the edge of the honing disc 18. The operator need only slide the blade clamp arm assembly back and forth along the curved guide bar 30 between the two stops 60, to sharpen the curved edge of the blade B along its entire length. FIG. 3 provides an illustration of this effect, with a first position shown in solid lines to the right with only the tip of the scissor blade B in contact with the outer edge of the disc 18, and a second position shown in broken lines illustrating the base or root of the blade B in contact with the edge of the disc 18. It will be seen that intermediate positions between the two positions shown, result in intermediate areas of the blade B edge being in contact with the edge of the disc 18. Thus, the entire curved edge of the blade B is honed or sharpened with a constant, uniform curvature as it passes across the edge of the disc 18, as the scissor blade B moves inwardly and outwardly relative to the center of the disc 18 as the blade clamp arm assembly traverses along the curved guide rod 30.

The proper bevel angle is automatically provided when the blade clamp arm assembly is rotated about the guide rod 30 to place the scissor blade B in contact with the edge of the disc 18 and the blade clamp 40 is retracted to its maximum extent toward the blade clamp arm 36, i.e. the stop pin 50 is contacting the underside of the blade clamp arm extension 52. However, it will be seen that the blade clamp 40 may be pivoted outwardly away from the blade clamp arm 36, i.e. counterclockwise in FIG. 4. This allows the operator to form a convex curvature across the cutting edge of the blade B, as is required on some scissors and shears. The operator need only swivel or rock the blade clamp 40 about its pivot 42 with the blade clamp arm 36 as the blade B traverses across the edge of the honing disc 18, as shown in FIG. 3 and described further above. The blade clamp arm 36 is free to pivot circumferentially about the guide bar 30 as the blade clamp 40 and blade B are rocked or pivoted about the pivot 42, thus allowing the blade B to remain in constant contact with the edge of the disc 18.

The blade sharpening operation continues as described above, with it generally requiring only a few passes back and forth along the edge of the honing or sharpening disc 18 until the blade is sharp. Different discs may be interchangeably installed upon the drive spindle 54 as desired or required, depending upon the amount of material which must be ground away to provide the desired curvature and blade edge angle, the finish required for the completed operation, etc. Once one scissor blade B has been sharpened, it is removed from the clamping jaw 44 and its mate secured therein, and the process repeated for the second blade.

Figure 6:
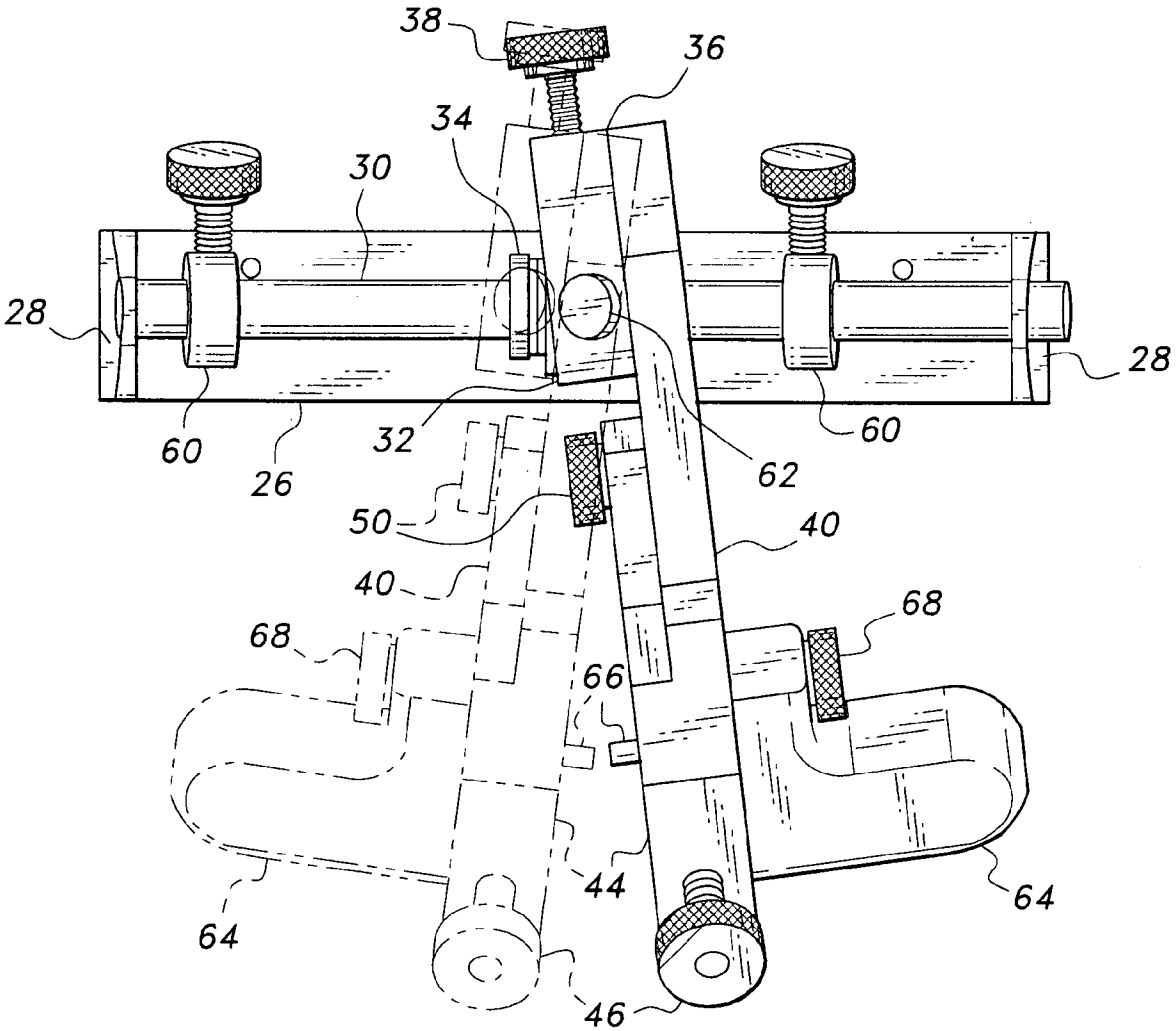
FIG. 6 is a top plan view of the blade guide and blade clamp assemblies, showing the alternative positioning of the blade clamp assembly on the blade guide assembly for sharpening left handed scissors.

The present sharpening machine may be used to sharpen left hand scissor blades as well as right hand blades. FIGS. 5 and 6 illustrate the configuration of the device for sharpening left hand scissor blades. Reconfiguring the machine from right hand blade sharpening operation to left hand sharpening operation requires only a few steps, and may be accomplished in less than a minute by an experienced operator of the present sharpening machine.

Initially, the blade clamp arm assembly, comprising the blade clamp arm 36, blade clamp 40, and blade clamp jaw 44, is adjusted angularly from a position slightly to the right of a line normal to the guide bar 30 to a position slightly left of such a normal line. The initial position for use in sharpening right hand scissor blades is shown in solid lines in FIG. 6, with the adjusted position for left hand blades being shown in broken lines in that Fig. This is accomplished by loosening the left/right position lock screw 38 in the blade clamp base 32, and swinging the blade clamp arm assembly angularly about its pivot 62. This adjusts the sweep angle between the scissor blade and the rotating honing disc 18, with the tip of the scissor blade remaining behind the center of the disc for both left and right hand sharpening. The blade clamp arm handle tab 64 is also reversed from the right side (as shown in FIG. 3 and in FIG. 6 in solid lines) of the scissor blade clamp 40, where it attaches below the jaw 44, to the left side (as shown in FIG. 5 and in FIG. 6 in broken lines). Mirror image locator pins 66 are provided on each side of the blade clamp 40, with a handle locking screw 68 securing the handle 64 to the right side (for right hand blades) or left side (for left hand blades), as desired.

The direction of rotation of the disc 18 is also reversed by means of the switch 22 (FIG. 1), and the splash guard 56 is reversed to the right side of the disc 18, as shown in FIG. 5. This is easily accomplished by inverting the guard 56 so that its second slot 58*b* is oriented downwardly, and sliding the edge having the second slot 58*b* into the right hand end of the track 24. The result is generally as shown in FIG. 5 of the drawings. The left hand scissor blade is installed in the blade clamp 44 in essentially the reverse orientation of that used for a right hand blade, i.e. with the handle extending to the left and the blade to the right, as viewed in FIG. 5. The sharpening operation is accomplished in essentially the same manner as described further above for a right hand scissor blade, i.e. the blade is worked back and forth (left to right, in FIG. 5) across the edge of the honing disc 18, with the curved cutting edge of the blade following the edge of the disc due to the corresponding curvature of the guide bar 30. The operator may hold the blade angle constant against the stop pin 50 in the blade clamp 40, or may rock the blade about the pivot axis 42 to form a convex curvature across the cutting edge, depending upon the blade configuration being sharpened. Other operations using coarser or finer discs, etc., are accomplished in essentially the same manner for either right or left hand blades.

In conclusion, the present sharpening machine not only maintains the precise 800 millimeter curvature along the length of the cutting edge of a scissor blade, but also assures that the precise bevel angle across the cutting edge of the blade is maintained during the sharpening operation. The limit or stop for the blade clamp arm assures that the bevel angle is precisely reground during the sharpening operation. Alternatively, the operator may form a convex curvature across the cutting edge where required, by rocking the blade about the pivot axis of the blade clamp pivot between the blade clamp arm and blade clamp. The versatility of the present sharpening machine enables an operator to sharpen the blades of either right hand or left hand scissors with equal ease. In consideration of the cost of extremely high quality scissors and shears, and the risk to the investment in such scissors and shears when they are improperly sharpened, the present sharpening machine will prove to be a most useful tool for those engaged in the scissor sharpening profession or activity, and will be much appreciated by the owners of high quality scissors and shears.

It is to be understood that the present invention is not limited to the embodiment described above, but encompasses any and all embodiments within the scope of the following claims.

I claim:

1. A scissor sharpening machine, comprising:

a base;

a guide bar track disposed upon said base;

a linearly adjustable, curved guide bar disposed upon said guide bar track;

a blade clamp assembly slidably mounted upon said guide bar, and restricted to axial and circumferential motion relative to said guide bar; and a motorized blade sharpening disc extending from said base and adjacent to said guide bar track, said guide bar, and said blade clamp assembly.

2. The scissor sharpening machine according to claim 1, wherein said blade clamp assembly further comprises:

a blade clamp arm slidably mounted upon said guide bar; and an angularly adjustable blade clamp disposed upon said blade clamp arm.

3. The scissor sharpening machine according to claim 1, wherein:

said base comprises a cabinet having a generally flat mounting base thereon; and said disc is disposed in a plane substantially parallel to the mounting base of said cabinet.

4. The scissor sharpening machine according to claim 1, wherein said blade clamp assembly further comprises:

a blade clamp arm slidably mounted upon said guide bar;

a blade clamp arm position lock extending from said blade clamp arm, selectively securing said blade clamp arm positionally for left hand or right hand operation;

an angularly adjustable blade clamp disposed upon said blade clamp arm; and a selectively positionable blade clamp handle secured to said blade clamp arm for left hand or right hand operation.

5. The scissor sharpening machine according to claim 1, further including:

a motor speed control; and a motor rotational direction control.

6. The scissor sharpening machine according to claim 1, further including a selectively reversible splash guard secured to said guide bar track.

7. The scissor sharpening machine according to claim 1, further including a light and magnifier lens disposed above said base.

8. A scissor sharpening machine, comprising:

a base;

a guide bar track disposed upon said base;

a linearly adjustable, curved guide bar disposed upon said guide bar track;

a blade clamp arm slidably mounted upon said guide bar;

an angularly adjustable blade clamp disposed upon said blade clamp arm; and a motorized blade sharpening disc extending from said base and adjacent to said guide bar track, said guide bar, said blade clamp arm, and said blade clamp.

9. The scissor sharpening machine according to claim 8, wherein said blade clamp arm is restricted to axial and circumferential motion relative to said guide bar.

10. The scissor sharpening machine according to claim 8, wherein:

said base comprises a cabinet having a generally flat mounting base thereon; and said disc is disposed in a plane substantially parallel to the mounting base of said cabinet.

11. The scissor sharpening machine according to claim 8, further including:

a blade clamp arm position lock extending from said blade clamp arm, selectively securing said blade clamp arm positionally relative to said guide bar for left hand or right hand operation; and a blade clamp handle selectively secured to said blade clamp positionally for left hand or right hand operation.

12. The scissor sharpening machine according to claim 8, further including:

a motor speed control; and a motor rotational direction control.

13. The scissor sharpening machine according to claim 8, further including a selectively reversible splash guard secured to said guide bar track.

14. The scissor sharpening machine according to claim 8, further including a light and magnifier lens disposed above said base.

15. A scissor sharpening machine, comprising:

a cabinet having a generally flat mounting base thereon;

a guide bar track disposed upon said mounting base;

a linearly adjustable curved guide bar disposed upon said guide bar track;

a blade clamp assembly slidably mounted upon said guide bar; and a motorized blade sharpening disc extending from said mounting base and adjacent to said guide bar track, said guide bar, and said blade clamp assembly, said disc being disposed in a plane substantially parallel to the mounting base of said cabinet.

16. The scissor sharpening machine according to claim 15, wherein said blade clamp assembly is restricted to axial and circumferential motion relative to said guide bar.

17. The scissor sharpening machine according to claim 15, wherein said blade clamp assembly further comprises:

a blade clamp arm slidably mounted upon said guide bar; and an angularly adjustable blade clamp disposed upon said blade clamp arm.

18. The scissor sharpening machine according to claim 15, wherein said blade clamp assembly further comprises:

a blade clamp arm slidably mounted upon said guide bar;

a blade clamp arm position lock extending from said blade clamp arm, selectively securing said blade clamp arm positionally for left hand or right hand operation;

an angularly adjustable blade clamp disposed upon said blade clamp arm; and a blade clamp handle selectively secured to said blade clamp positionally for left hand or right hand operation.

19. The scissor sharpening machine according to claim 15, further including:

a motor speed control; and a motor rotational direction control.

20. The scissor sharpening machine according to claim 15, further including:

a selectively reversible splash guard secured to said guide bar track; and a light and magnifier lens disposed above said cabinet.

* * * * *